United States Patent [19]

Simmons et al.

[11] Patent Number: 4,727,929

[45] Date of Patent: Mar. 1, 1988

[54] INVESTMENT SHELL MOLDING APPARATUS AND METHOD

[75] Inventors: John H. Simmons, Lyndhurst, Ohio; Jerald J. Seymer, Manchester, Wis.

[73] Assignee: Precision Metalsmiths, Inc., Cleveland, Ohio

[21] Appl. No.: 786,896

[22] Filed: Oct. 11, 1985

[51] Int. Cl.[4] ..... B22C 9/04; B22C 13/08

[52] U.S. Cl. ..... 164/516; 118/416; 118/425; 164/166; 427/204; 427/430.1

[58] Field of Search ..... 164/516, 517, 518, 519, 164/36, 166, 165, 161; 118/425, 426, 416; 427/204, 430.1

[56] References Cited

U.S. PATENT DOCUMENTS

| | | | |
|---|---|---|---|
| 2,859,497 | 11/1958 | Winter | 164/166 |
| 2,932,864 | 4/1960 | Mellen, Jr. et al. . | |
| 3,231,946 | 2/1966 | Watts et·al. . | |
| 3,278,998 | 10/1966 | Tingquist et al. | 164/166 |
| 3,307,232 | 3/1967 | de Fasselle et al. | 164/516 X |
| 3,424,227 | 1/1969 | Watts et al. | 164/36 |
| 3,446,266 | 5/1969 | Watts et al. | 164/166 X |
| 3,503,435 | 3/1970 | Dunlop | 164/166 |
| 3,602,288 | 8/1971 | Trench et al. | 164/166 |
| 3,796,251 | 3/1974 | Jasson et al. | 164/166 |
| 4,040,466 | 8/1977 | Horton et al. | 164/161 X |
| 4,295,444 | 10/1981 | Hatta et al. | 118/668 |

FOREIGN PATENT DOCUMENTS

| | | | |
|---|---|---|---|
| 204889 | 12/1955 | Australia | 164/166 |
| 56-134044 | 10/1981 | Japan | 164/166 |
| 988454 | 4/1965 | United Kingdom . | |

*Primary Examiner*—Nicholas P. Godici
*Assistant Examiner*—J. Reed Batten, Jr.
*Attorney, Agent, or Firm*—Watts, Hoffmann, Fisher & Heinke Co.

[57] ABSTRACT

An apparatus and method for automatically forming ceramic shell molds as part of an investment casting process. The apparatus includes structure defining a plurality of processing stations which together define a process line through which set ups are conveyed and coated with cermic material. The first station includes a pickup arm assembly operative to transfer a set up from a transfer cart to a slurry tank where it is released. A transfer arm forming part of a second station engages the set up rotates it within the slurry tank for a predetermined time, after which, the slurry transfer arm transfers it to a spin-off tank and releases it. A stucco transfer arm assembly forming part of a third station engages the set up and rotates it to spin-off excess slurry solution after which the stucco transfer arm transfers it to a stucco tank and releases it. A third transfer arm assembly forming part of a fourth station then re-engages the set up and rotates it in the stucco tank so that a uniform coating of stucco or refractory material is deposited. The set up is then transferred to a scraper unit where it is engaged by a final transfer arm assembly which rotates it within the scraper unit to scrape the slurry and stucco coating from predetermined portions of the set up and then transfers it to a discharge transfer cart.

14 Claims, 16 Drawing Figures

30
170
172a
164
166
188a
180a'
32
150
188
181
180
156
158
182
150
30
28'
164
180a
160
28
145
146a'
142
140
28
28
28'
144
102
102
106
102
28
28
28
146
145
146a
145
146a
142
26

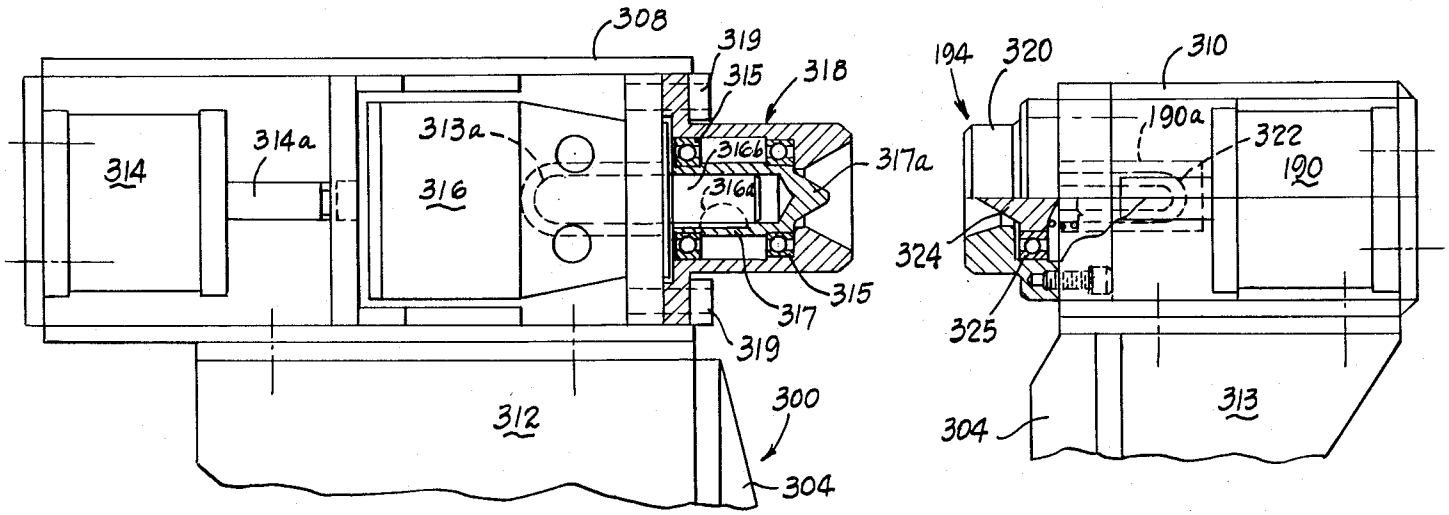
Fig. 11
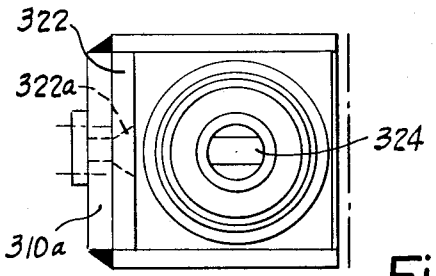
Fig. 12
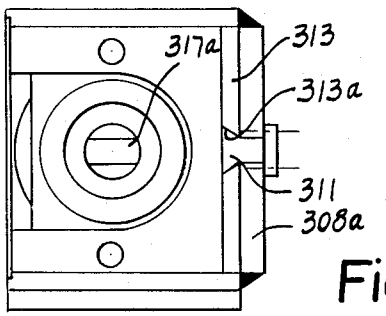
Fig. 9
Fig. 10

INVESTMENT SHELL MOLDING APPARATUS AND METHOD

TECHNICAL FIELD

This invention relates generally to the art of investment casting, and more specifically to ceramic shell molding techniques of investment casting wherein shell molds suitable for casting metal are prepared by building up layers of refractory material around disposable patterns that are subsequently removed from the molds.

BACKGROUND ART

Ceramic shell molds are prepared using patterns that are replicas of the parts to be cast and which may include the necessary gates and risers. The patterns are formed of any expendable materials, such as wax or a suitable synthetic resin or blends of wax and resin. These patterns are attached to a central support or sprue member to form what is known as a "set up" or "tree". An example of a "set up" is illustrated and described in U.S. Pat. No. 3,424,227, owned by the present assignee and hereby incorporated by reference.

The formation of a shell mold around the tree is generally accomplished by applying a refractory slurry coating of controlled viscosity followed by directional draining to coat the patterns completely. After draining excess slurry from the tree, the slurry coating is sanded or stuccoed while wet with coarser refractory materials. This layer is hardened, as by forced air drying at room temperature. The result is a layer of ceramic material having refractory particles embedded in the surface. After the first ceramic layer is sufficiently hard and dry, the steps of coating, draining, stuccoing and drying are repeated until a refractory shell having a sufficient thickness to resist the stresses occurring in subsequent operations has been built up around the tree. In a subsequent pattern removal operation, the tree, including the patterns, is removed from the shell mold and it is prepared for the casting operation.

In the past, the coating of set ups has been labor intensive. Attempts have been made to automate the coating process. In U.S. Pat. Nos. 3,278,998 and 4,295,444 machines for carrying set ups through a series of coating steps are illustrated. In general, both machines are rotary in nature and carry the set ups being coated in a circular path with the various processing stations located at predetermined intervals.

DISCLOSURE OF THE INVENTION

The present invention provides a new and improved mold making apparatus and method for automatically forming ceramic shell molds as part of an investment casting process.

In the preferred embodiment, the apparatus comprises a plurality of stations defining a process line through which a set up assembly (containing one or more patterns) is conveyed. An example of a "set up" hereinafter referred to as a "drum," is illustrated in U.S. Pat. No. 3,424,227. It is to be understood that the invention is not limited to the particular drum-shaped "set up" assembly illustrated in the drawings.

According to the exemplary embodiment, the first station comprises a drum support structure supporting a plurality of spaced apart drums and a pickup arm assembly which is operative to sequentially engage the drums supported on the drum support structure. The pickup arm assembly transfers an engaged drum from the support structure to a slurry unit.

At least a portion of the drum is immersed in a slurry tank forming part of the slurry unit. The drum is rotated in order to uniformly coat the surface of the drum and patterns with the slurry solution.

A second station is disposed adjacent and laterally spaced from the first station and includes a transfer arm assembly for engaging the drum in the slurry unit and transferring it to a spin-off tank forming part of the second station. There the drum is again rotated in order to spin-off excess slurry so that a uniform coating of slurry is deposited on the patterns.

A third station, adjacent the second station includes another transfer arm assembly which is operative to engage the drum at the spin-off tank and transfer it to a stucco tank where the drum is spun in the presence of a fluidized bed of stucco material. By rotating the drum, the patterns, still wet with slurry, take on a coating of dry stucco material.

A fourth station, located laterally adjacent the third station, includes another transfer arm assembly for engaging the drum at the stucco tank and moving it to a scraper unit where the slurry and stucco coating is scraped from one or more splitter discs forming part of the drum. A loading arm assembly forming part of a fifth station, engages the drum and loads it on to another drum supporting structure.

In accordance with the perferred and illustrated embodiment, the drum supporting structures at the beginning and end of the process line comprise a movable rack or transfer cart that includes vertically spaced, but aligned, laterally extending support members. Each member is configured to support a drum at opposite ends.

According to a feature of the invention, a turntable mechanism located at the beginning of the process line, is operative to rotate the transfer cart 180°. With this configuration, the drums located at one end of each support member are sequentially engaged and transferred to the slurry unit by the pickup arm assembly. After all the drums have been removed from one side of the transfer cart, the cart is rotated 180° to present the other side of the transfer cart to the first station so that the drums can be retrieved by the pickup arm assembly.

A similar turntable arrangement is located at the discharge end of the process line so that the drums can be loaded on to both ends of the support members forming part of the transfer cart.

According to another feature of the invention, rotation of a drum at the slurry unit, spin-off tank, stucco tank and scraper unit is achieved by rotary drive mechanisms forming part of the transfer arm assemblies. With the preferred system, the drums can be rotated not only in the various tanks, but can continue rotating as they are being transferred. For example, rotation of the drum is continued as it is lifted from the slurry unit in order to drive off excess slurry as the drum is being transferred to the spin-off tank.

In the preferred construction, each arm assembly includes a pair of spaced, parallel arms that extend radially from a common pivot axis. The engagement and release of a drum by the transfer arm assembly is achieved by a pair of actuators located at the distal ends of the arms forming a given arm assembly. The drum normally includes a support rod or shaft which extends through the drum along its central axis. The shaft extends beyond endplates or sideplates of the drum. Each arm of a given arm assembly includes a coupling engageable with one end of the drum shaft. The coupling is driven towards and away from the associated end of the shaft by actuators mounted at the ends of the arms and operatively connected with the couplings.

For those arms that produce rotation in the drum, a drive motor is located on one of the arms which is slidably carried in a mounting unit and connected to the coupling actuator. In the arms which include the drive motor, the coupling actuator for effecting engagement of the drum, actually drives the hydraulic motor, including the shaft coupling, towards and away from one end of the drum shaft to effect engagement and release of the drum.

According to another feature of the invention, the spin-off tank assembly serves as a slurry reservoir for the slurry unit. With this arrangement, the excess slurry spun off a given drum is made available and ultimately returned, to the slurry tank. In addition, in the preferred embodiment, as slurry is consumed in the slurry tank, replenishment slurry is added to the spinoff tank and then transferred to the slurry tank.

With the disclosed apparatus and method, fully automatic coating of set ups or drums is possible. The drums to be coated are simply loaded onto the transfer cart which is then moved to the beginning of the process line and onto the turntable. Once located at the turntable, the pickup arm assembly of the first station can sequentially engage and transfer drums from the transfer cart to the slurry unit. The coated drums are then eventually transferred to the discharge transfer cart located at the end of the process line where they can then be moved to another location for further processing or alternately can be returned to the beginning of the process line in order to receive additional coatings.

Additional features of the invention will become apparent and a fuller understanding obtained by reading the following detailed description made in connection with the accompanying drawings.

BRIEF DESCRIPTION OF DRAWINGS

FIG. 9 is a fragmentary view of a drum driving apparatus constructed in accordance with the preferred embodiment of the invention;

FIG. 10 is a side elevational view as seen from the plane indicated by the line 10—10 in FIG. 9;

FIG. 11 is a fragmentary view of a coupling apparatus forming part of the present invention;

FIG. 12 is a side elevational view seen from the plane indicated by the line 12—12 in FIG. 11; and;

Best Mode for Carrying Out Invention

The present invention comprises a apparatus and method for automatically coating set ups or "drums" as part of an investment casting process. As is known, the set up comprises a central support which may be drum-shaped that carries a plurality of patterns formed from an expendable material such as wax. For purposes of explanation only, the set up will be referred to as a "drum".

Figure 1:
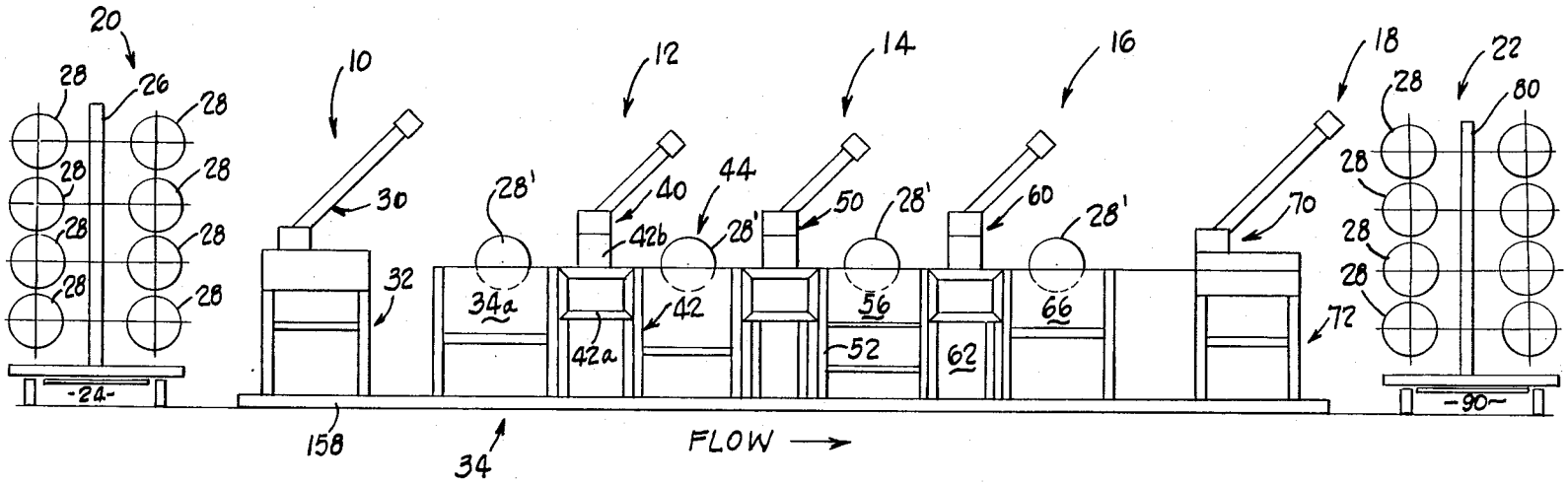
FIG. 1 is a diagrammatic view of an apparatus for automatically forming ceramic molds, embodying the present invention.

Referring to FIG. 1, the overall apparatus defines a substantially rectilinear processing line having five transfer stations which are indicated generally by the reference characters 10, 12, 14, 16, and 18 respectfully.

A drum supply station, indicated generally by the reference character 20 is positioned at the beginning of the processing line. A discharge station, similar to the supply station, is located at the end of the processing line and is indicated generally by the reference character 22.

The supply station 20 includes a turntable assembly 24 which is operative to support and rotate a transfer cart 26. The cart 26 is adapted to carry a plurality of set up assemblies or drums 28, to be coated. In the illustrated embodiment, the cart assembly 26 is designed to carry eight (8) drums 28.

Figure 2A:
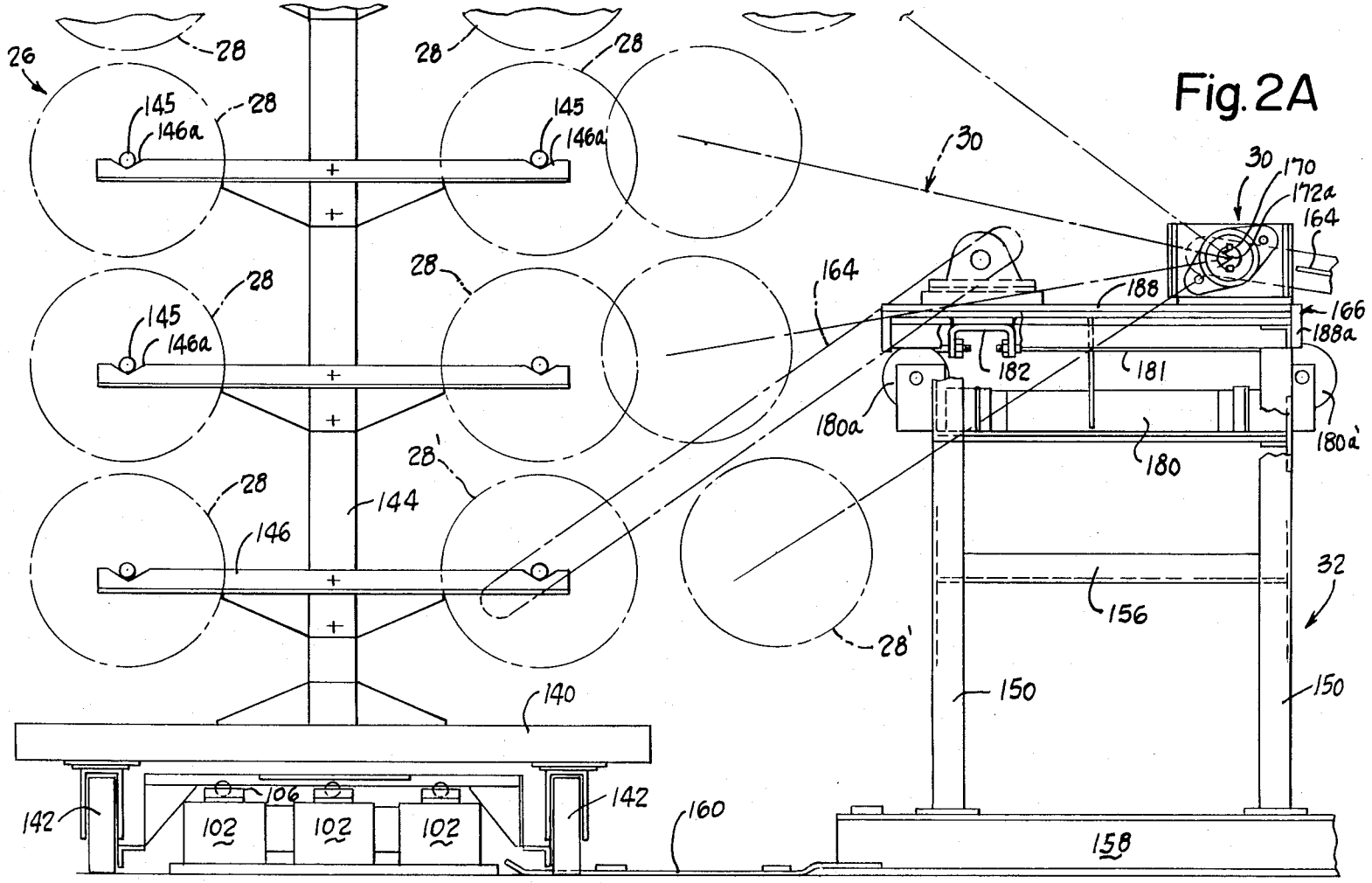
FIGS. 2A–2D are elevational views of the various stations that comprise the apparatus shown in FIG. 1.

Referring also to FIG. 2A, the first transfer station 10 comprises a pickup arm assembly 30 supported for rotative and rectilinear movement by a support stand 32, positioned laterally adjacent the turntable assembly 24.

Figure 2B:
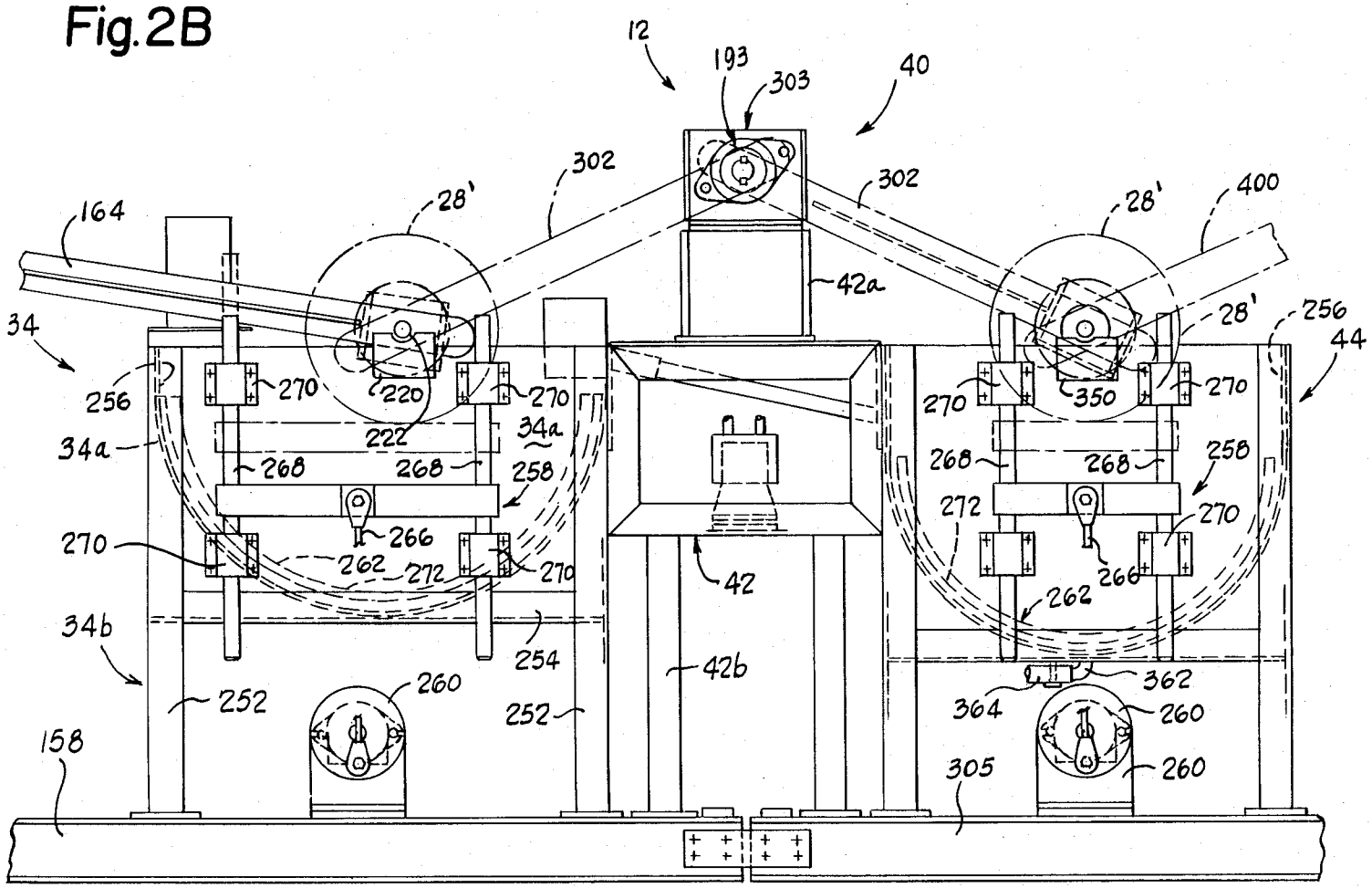

Referring to FIGS. 1 and 2B, the second station 12 includes a slurry transfer arm assembly 40 supported for rotative movement about a substantially transversel axis by a support stand 42.

The pickup arm assembly 30 commences the coating process and in particular, transfers one of the drums 28' to a slurry unit, indicated generally by the reference character 34 that includes a slurry tank **34*a***.

The slurry transfer arm assembly 40 has two functions. Firstly, it engages the drum assembly 28' while the drum is located and partially submerged in the slurry solution and imparts rotation to the drum to cause all of the patterns to be coated. After a predetermined dwell time in the slurry tank **34*a*, the slurry transfer arm assembly 40 transfers the drum to a slurry spin-off tank indicated generally by the reference character 44**.

Figure 2C:
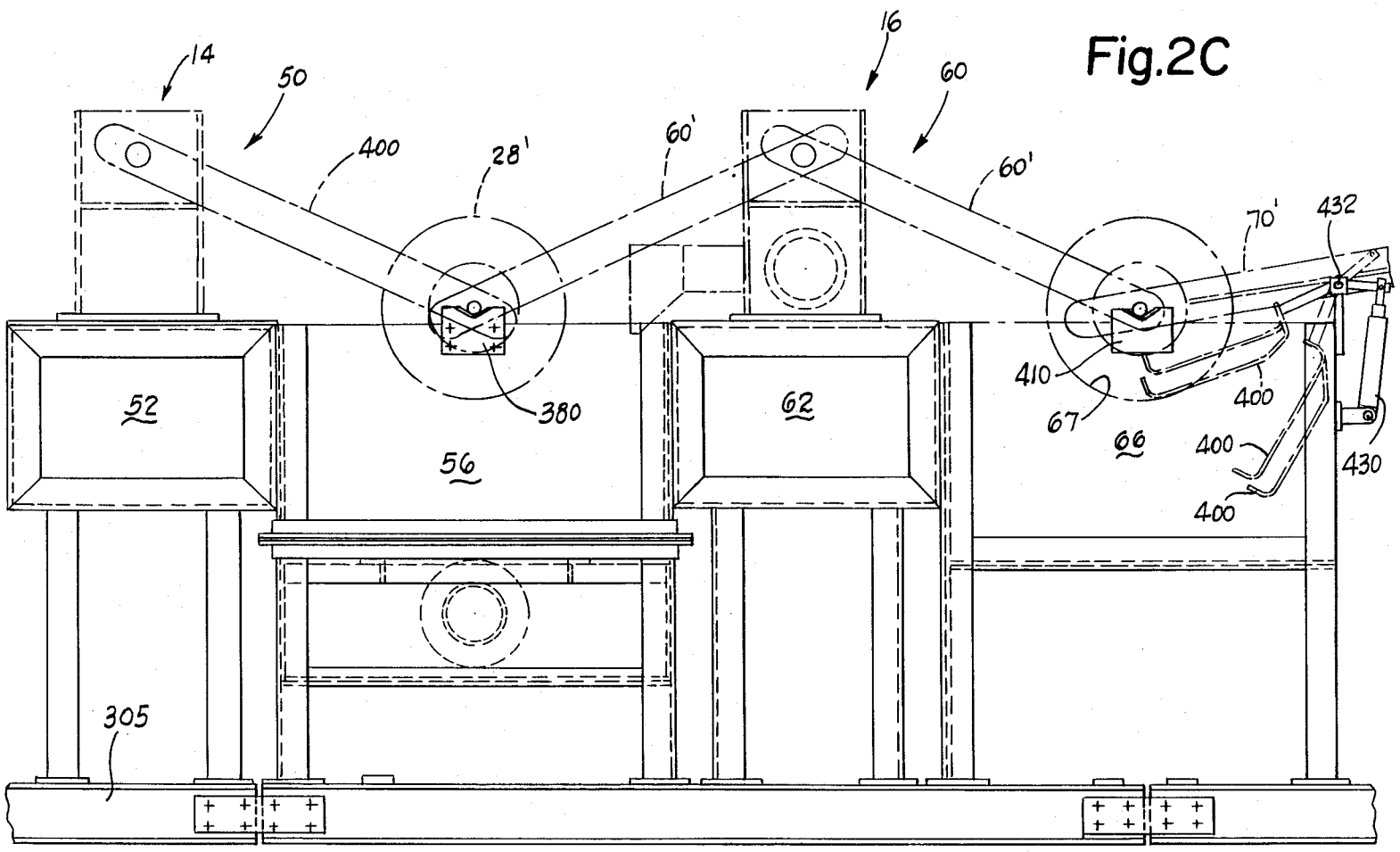

Referring to FIGS. 1, 2B and 2C, the third processing station 14 includes a slurry -off transfer arm assembly 50 supported for rotative movement about a substantially transversal axis by a support stand 52. Like the slurry transfer arm assembly 40, the slurry spin-off arm assembly 50 also performs two functions. Firstly it engages the drum 28' while it is located at the spin-off tank 44 and imparts rotation to the drum to cause excess slurry to be spun off. Secondly, after a predetermined dwell time, the slurry spin-off transfer arm assembly 50 transfers the drum 28' to a stucco tank 56 at which the drum is uniformly coated with a powdered refractory material.

The fourth transfer station 16 includes a stucco transfer arm assembly 60 supported for rotative movement about a substantially transversel axis, by a support 62. The stucco transfer arm assembly 60 is operative to engage the drum 28 at the stucco tank 56 and impart rotation to the drum to cause a uniform coating of the refractory material to be deposited on the drum while still wet with the slurry received in the slurry tank 34a. After a predetermined dwell time, the drum 28' is transferred by the arm assembly 60 to a scraper unit 66 at which the accumulated slurry and refractory coating is scraped from "splitters" (not shown) forming part of the drum. The scraping of the splitters facilitates separation of the component parts of the drum when the coating process is complete. End plates 67 of the drum may also be scraped.

Figure 2D:
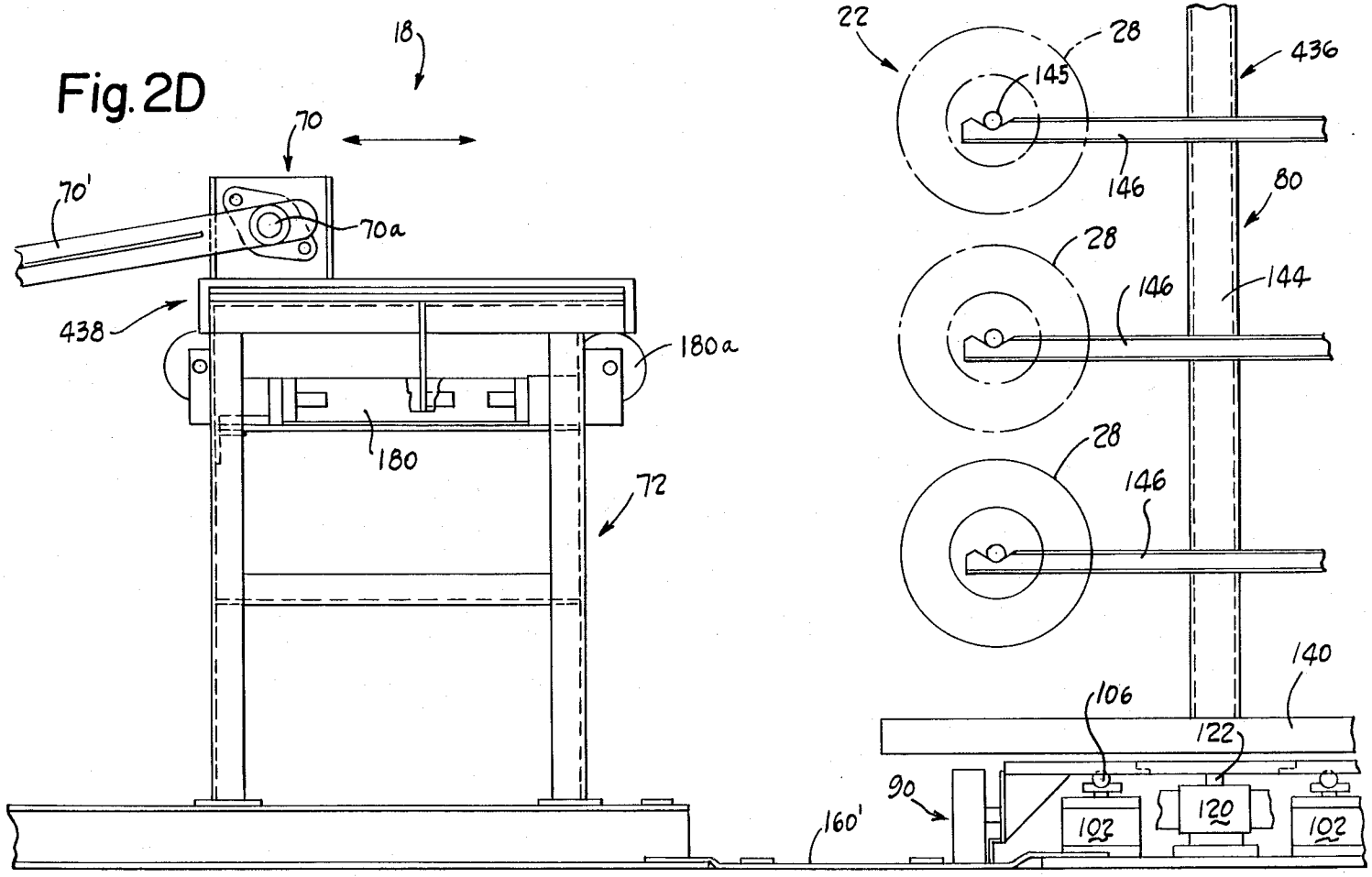

Referring to FIGS. 1 and 2D, the fifth transfer station 18 includes a final transfer or loading arm assembly 70 which is mounted for rotative and rectilinear movement on a support stand 72. The arm assembly 70 is operative to engage the drum assembly 28' at the scraping unit 66 and imparts rotation so that the scraper unit 66 (shown only in FIG. 2C) can engage and scrape the slurry coating from one or more splitters that form part of the drum assembly.

At the conclusion of the scraping operation, the final transfer arm assembly 70 transfers the drum 28' from the scraping unit 66 to another transfer cart 80 which may be identical to the transfer cart 26 located at the beginning of the processing line. The transfer cart 80 is also adapted to support a plurality of drums 28.

The discharge station 22 includes another turntable assembly 90 which is operative to rotatably support the transfer cart 80 for rotation about a substantially vertical axis.

Features of the various stations will now be described in more detail. Turning first to FIGS. 2A and 5–7, the turntable assembly 24 is illustrated. In the preferred embodiment, the turntable 90 at the discharge station 22 is similarly constructed and therefore only one assembly will be described.

The assembly 24 includes a base plate 100 on which are mounted four symmetrically spaced actuators 102. The actuators 102 rotatably support a support plate 104. To achieve this support, each actuator 102 carries a ball bearing 106 at the upper end of its associated actuating rod indicated generally by the reference character 108. In particular, a bearing seat 110 is carried at the upper most end and includes a recess 110a which receives the ball bearing 106. A circular groove 112 is formed in the support plate 104 and serves as a common track for the bearings 106. In operation, the actuators 102 are pressurized to extend their associated actuating rods 108. The support plate 104 is then rotated 180° about a vertical axis for the purposes set out below.

As best seen in FIG. 2A, the transfer cart 26 includes a base 140 supported above ground level by a plurality of casters 142, preferably four (only two of the casters are shown). A vertical column 144 extends upwardly from the base 140 and supports a plurality of pairs of transverse members 146 in a tree-like fashion. Only one transverse member 146 of a pair are shown. At each level, a pair of support members 146 is located on either side of the vertical column support 144. The spacing between the paired members 146 is at least as large as the axial length of the drums so that a support shaft 145 which normally extends through the center of the drum 28 is supported at opposite ends by a pair of members 146. The members 146 include a V-shaped notches 146a to prevent a drum 28 from falling off the members 146.

Each pair of support members 146 supports a pair of drum assemblies 28 at opposite ends. The drum assemblies 28 on one side of the vertical column 144 are substantially in vertical alignment.

Figure 6:
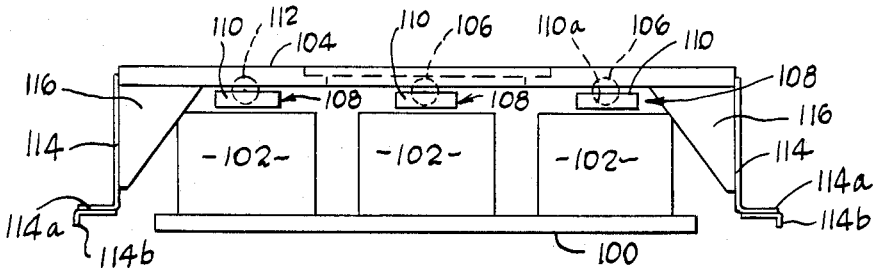
FIG. 6 is a side elevational view of the apparatus shown in FIG. 5.
Figure 5:
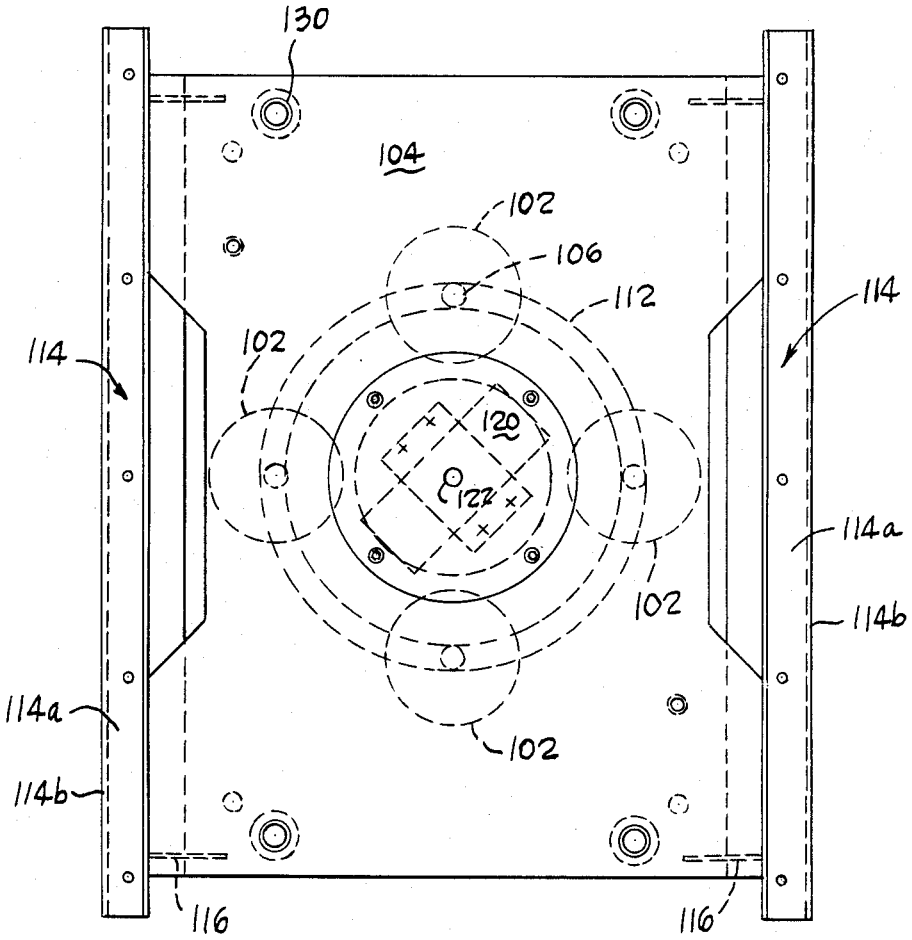
FIG. 5 is a fragmentary top plan view of a turntable assembly forming part of the present invention.

In operation, the transfer cart 26 is loaded with drums 28 to be coated and rolled onto or over the turntable assembly 24. Referring to FIGS. 5 and 6, the turntable support plate 104 mounts a pair of downwardly depending flange-like members 114 along opposite sides. A gusset plate 116 rigidizes the mounting of each flange-like member 114. Each member 114 includes laterally extending caster abutment channels 114a which serve as guides for positioning the transfer cart 26 in alignment with the support plate 104. The transverse dimension between respective caster abutments 114b corresponds to the transverse distance between the inside faces of the casters 142. The transfer cart is thus positioned in alignment with the turntable plate 104 such that the abutments 114b are positioned between the casters and the transfer cart is then rolled over the support plate 104.

Figure 7:
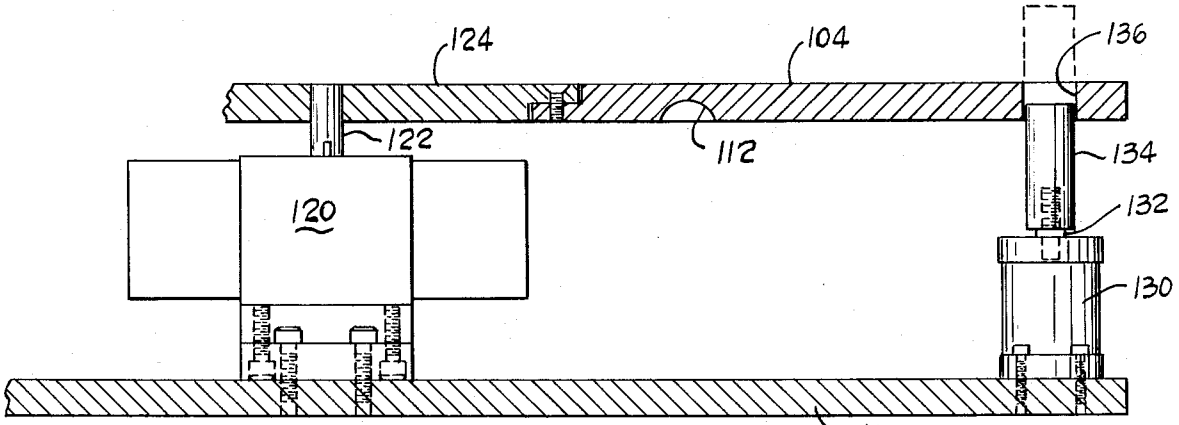
FIG. 7 is fragmentary side view, with parts omitted for clarity, of the apparatus shown in FIG. 5.

The transfer cart is maintained in longitudinal alignment with the support plate 104 by a locking arrangement best seen in FIGS. 5 and 7. As seen in these Figures, four actuators 130 are mounted below and near the corners of the support plate 104. Each actuator includes an actuating rod 132 that carries a stop bar 134. The actuators 130 on one side of the support plate 104 act together and serve as a stop for the transfer cart 26 as it is being rolled onto the turntable assembly 24. Once the transfer cart reaches one pair of stops 130, the remaining pair of stops are raised in order to lock the position of the transfer cart 26 in predetermined alignment with the support plate 104.

As seen best in FIG. 2A, a series of vertically aligned drums, supported by the transfer cart 26, are engageable by the pickup arm assembly 30. In order to engage and remove the drums located to the left of the column 144 (as viewed in FIG. 2A) the transfer cart 26 must be rotated 180°.

Rotation of the support plate 104 is effected by a rotary actuator 120 which includes a drive shaft 122 that is fixed to a turntable cap 124. The turntable cap 124 is in turn bolted to the support plate 104. The drive shaft 122 defines the vertical axis of rotation.

To effect rotation of the transfer cart 26, the actuators 102 must be energized to raise the support plate 104 in order to lift the transfer cart from the floor. The actuators 130 are then deactivated in order to retract their associated actuating rods 132 thus causing the associated stop bars 134 to move downwardly and disengage the support plate 104. After the support plate 104 is raised and then disengaged by the stop bars 134, the rotary actuator 120 is then energized to cause a 180° revolution in the support plate 104. After rotating 180°, the actuators 130 are again re-energized to lock the plate 104 in its new position and to lock the position of the cart 26 on the plate 104.

As will be explained further on, the pickup arm assembly 30 located at the first station 10 is operative to sequentially engage the drums 28 located on one side of the transfer cart 26 and transfer them to the slurry tank 34a (shown in FIG. 1). After the four drums 28 are removed, the turntable assembly 24 is energized to rotate the transfer cart 26 to present the four drum assemblies located on the opposite side of the vertical column 144 to the pickup arm assembly so they too can be transferred to the slurry tank 34a. As should be apparent, the actuators 102 raise the transfer cart 26 to lift the casters 142 from the floor to enable cart rotation. When the drum assemblies 28 have all been discharged from the transfer cart, the actuators 102 are de-energized to lower the cart onto the floor so that it can be rolled from the turntable assembly 24. Another filled transfer cart 26 is then rolled onto the assembly 24 where the sequence begins again.

Referring to FIGS. 1, 2A, 3 and 8, the construction of the first transfer station 10 will be described. As indicated above, the support frame 32 mounts a pickup arm assembly 30. The support frame 32 includes a plurality of vertical support legs 150 interconnected by transverse members 152, 154 and 156. The vertical legs 150 sit atop a transverse I-beam member 158 (shown only in FIGS. 1 and 2A). The I-beam member 158 is tied to the turntable assembly 24 by a tie plate 160 which fixes the relative position of the turntable assembly 24 with respect to the first station.

Figure 3:
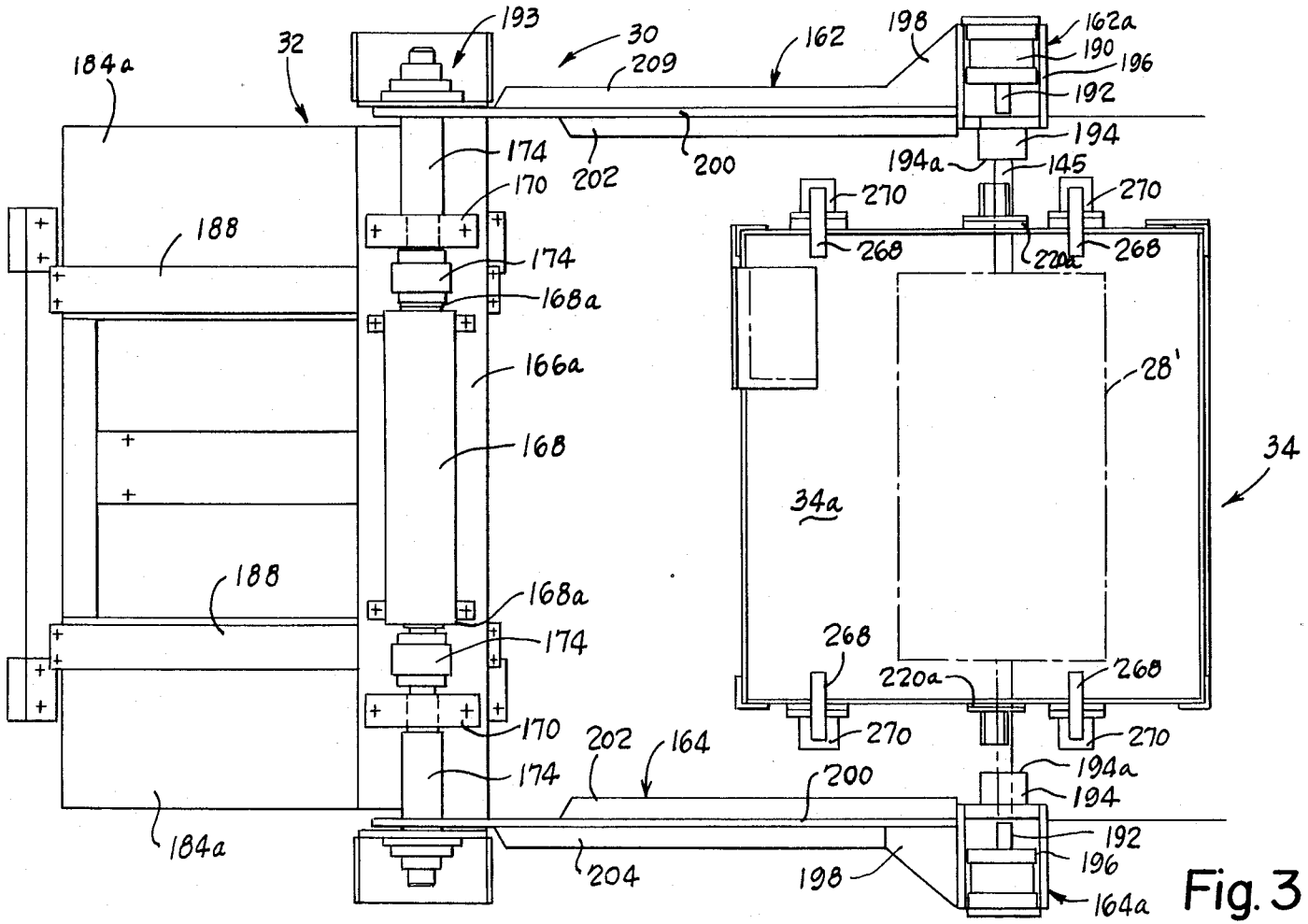
FIG. 3 is a fragmentary top plan view of the apparatus shown in FIGS. 2A–2B.
Figure 8:
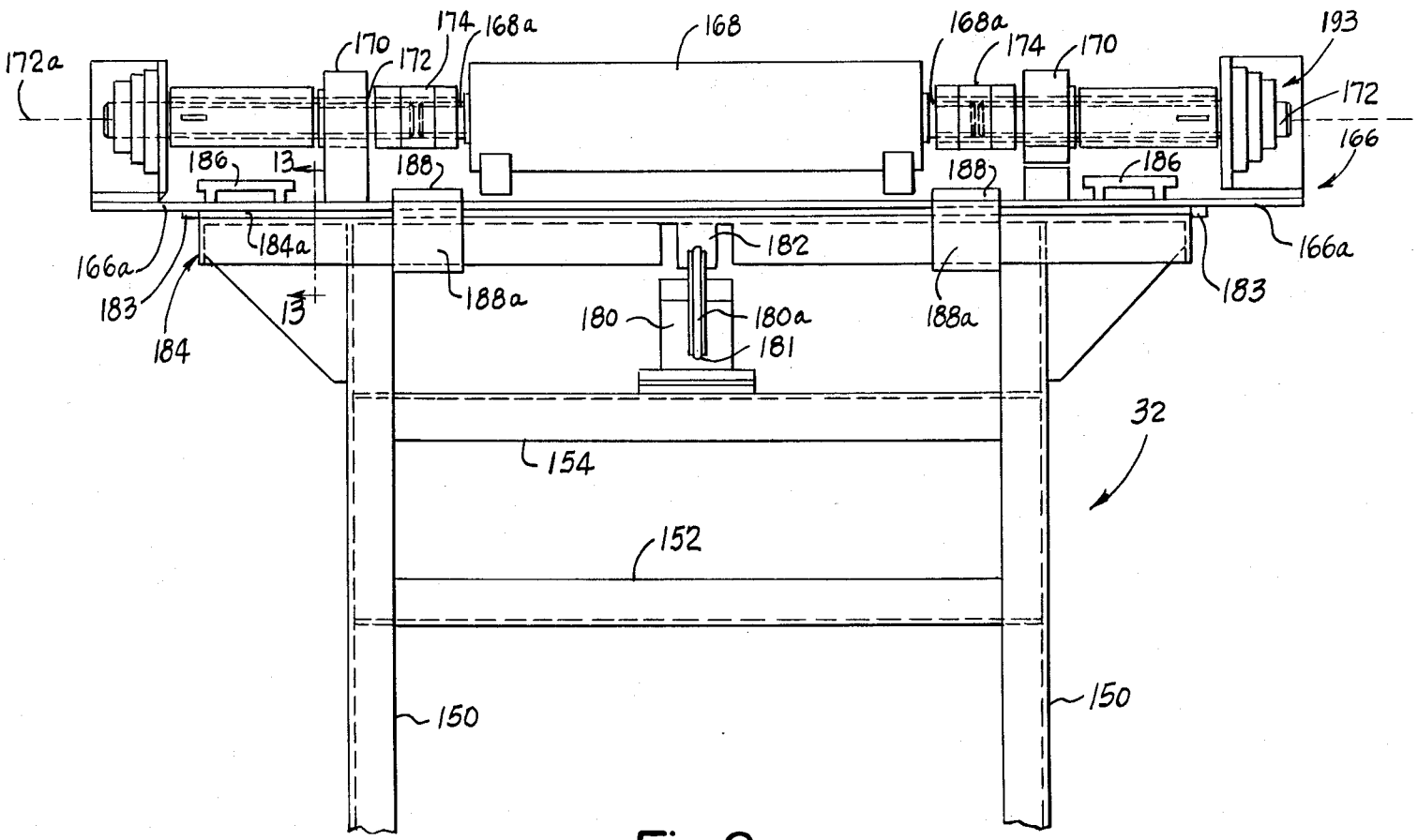
FIG. 8 is an end view of a pickup assembly forming part of the present invention.

As seen best in FIGS. 3 and 8, the arm assembly 30 comprises a pair of pivotally movable arms 162, 164. The arms 162, 164 and associated drive components are mounted on a slide assembly 166 which is transversly movable (as viewed in FIG. 2A) with respect to the support frame 32. The extremes in transverse movement of the arm assembly 30 are illustrated using phantom and solid lines. The rightmost position of the arm assembly 30 is shown in phantom in FIG. 2A.

The slide assembly 166 includes a rather narrow base plate **166*a* that mounts a rotary actuator 168 including output shaft ends 168*a*. The actuator may be of conventional construction. An example of such an actuator is available from HELAC CORPORATION. The base plate 166*a* mounts a pair of pillow blocks 170 disposed adjacent to the output shaft ends 168*a* of the actuator 168. Each pillow block 170 supports a shaft 172 that is connected to a respective arm 162, 164 and is in turn coupled to an associated output shaft end 168*a* of the actuator 168 by coupling member 174. When the rotary actuator 168 is actuated, the arms 162, 164 move in unison about a pivot axis 172*a* defined by the shaft 172** (see FIG. 2A).

As seen best in FIG. 2A, when a drum 28' is engaged by the arms 162, 164 it is moved through a vertical arcuate path and deposited, by the pickup arm assembly 30 at the slurry unit 34 (See FIG. 2B).

As discussed above, a plurality of vertically spaced drums 28 are presented by the transfer cart 26. In order to engage any one of the four drums, the radial distance between the pivot axis **172*a* of the pickup arm assembly 30 and the shaft 145 of the drum 28' to be engaged must be adjusted to compensate for the differences in elevation of the drums. This is achieved by the slide assembly 166. As seen in FIG. 8, the cross members 154 (only one is shown) mount a transversely extending actuator 180 which in the preferred embodiment includes a cable drive. The illustrated actuator 180 is of a conventional construction and is sold under the tradename CABLE-TROL. A cable 181 (or alternately a chain) is reeved around a pair of pulleys 180*a* and is connected to a drive bracket 182. The drive bracket in turn is connected to the underside of the base plate 166*a*. The actuator 180 is double acting and can drive the bracket either left or right (as viewed in FIG. 2A). When the bracket 182 is driven rightwardly, the pickup arm assembly 30 moves to the right. Conversely, when the bracket 182 is driven leftwardly, the arm assembly 30 moves towards the transfer cart 26**.

Referring in particular to FIGS. 2A, 3, 8 and 13, the base plate **166*a* is mounted for transverse movement above the support stand 32. The base plate 166*a* rides above a support plate 184 that is fixed to the top of the support stand 32. The support plate 184 includes a machine load bearing plate 184*a* which directly supports the slide assembly 166**.

Figure 13:
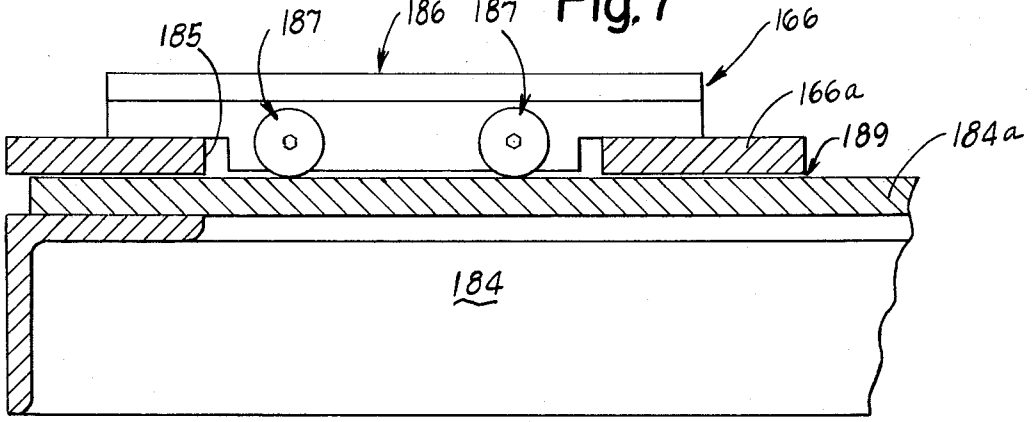
FIG. 13 is a sectional view as seen from the plane indicated by the line 13—13 in FIG. 3.

As seen best in FIG. 13, the slide assembly 166 also includes a bearing plate 186 fixed to the base plate **166*a* which mounts a plurality of rollers 187. The rollers 187 extend through an aperture 185 formed in the base plate 166*a* and ride atop the load supporting plate 14*a*. In the preferred arrangement, the rollers 187 are adjustable towards and away from the plate 184*a* and are adjusted so that a slight clearance is established between the base plate 166*a* and the plate 184*a* as indicated by the reference character 189**.

As seen in FIGS. 3 and 8, a pair of hold down plates 188 extend across and above the base plate **166*a* and keep the base plate 166*a* atop the support plate 184. The base plate 166*a* is maintained in predetermined alignment by bearing blocks 183 which are fixed to the underside of the base plate 166*a* and which run along the side edge of the support plate 184*a* and transmit lateral thrust loads from the arm assembly 30 to the support stand 32. The hold down plates 188 are fixed to the support stand 32 by downwardly depending mounting plates 188*a***.

The hold down plates 188 prevent vertical separation of the base plate **166*a* from the support stand 32. The bearing blocks 183 control the precise lateral movement of the support plate 166*a* and hence the pickup arm assembly 30. In addition, the mounting plates 188*a* which mount the hold down plates 188 serve as abutments to prevent the base plate 166*a* from sliding off the support stand 132**.

By controlled actuation of the actuator 180, the arms 162, 164 can be moved into engagement with any of the four drums 28 located on the transfer cart 26. In the preferred embodiment, the radial position of one or both arms 162, 164 is monitored by a position sensor such as a conventional rotary encoder which is indicated generally by the reference character 193. After a drum 28' is engaged, the arms 162, 164 are pivoted, and if necessary the entire arm assembly 30 is moved rightwardly so that the engaged drum assembly 28' can be deposited at the slurry tank **34*a***.

The drum assembly 28' is engaged and released by the arms 162, 164 through a coupling arrangement that is preferably driven by fluid pressure operated actuators. Referring in particular to FIG. 3, a drum holder assembly is preferably located near the distal ends **162*a*, 164*a* of each of the arms 162, 164, respectively. The drum holder assembly comprises an actuator 190 including an actuating rod 192 which mounts a coupling member 194. The actuator 190 is double acting and may be of conventional construction. The components are mounted in a sleeve-like member 196 that is fixed to the distal ends of each arm 162, 164. A gusset plate 198 extends between the sleeve member 196 and a center plate member 200 of each arm to rigidize the mounting of the sleeve 196. Rigidizing ribs 202, 204 are suitably fixed as by welding to opposite sides of the center plate 200** to strengthen and rigidize the arm itself.

In operation, the actuators 190 are retracted in order to move the coupling members 194 outwardly to a retracted position; the retracted distance between end faces **194*a* of the coupling members 194 is greater than the length of the drum support shaft 145**.

In order to engage a drum 28' located on the transfer cart 26, the pickup arm assembly 30 is rotated and moved transversely until the coupling members 194 are aligned with opposite ends of the drum support shaft 145. The cylinders 190 are then actuated to extend their actuating rods 192 thus causing the coupling members 194 to move towards and receive and then clamp opposite ends of the drum shaft 145. The arm assembly is then actuated to lift and translate the engaged drum assembly to the slurry tank 34*a*.

Referring also to FIG. 2B, the pickup arm assembly 30 lowers the drum 28' onto a drum rest forming part of the slurry tank 34*a*. The rest comprises a pair of plates 220*a* located on opposite sides of the slurry tank 34*a*. Each plate 220*a* includes a recess 222 adapted to receive one end of the drum support shaft 145.

Figure 4:
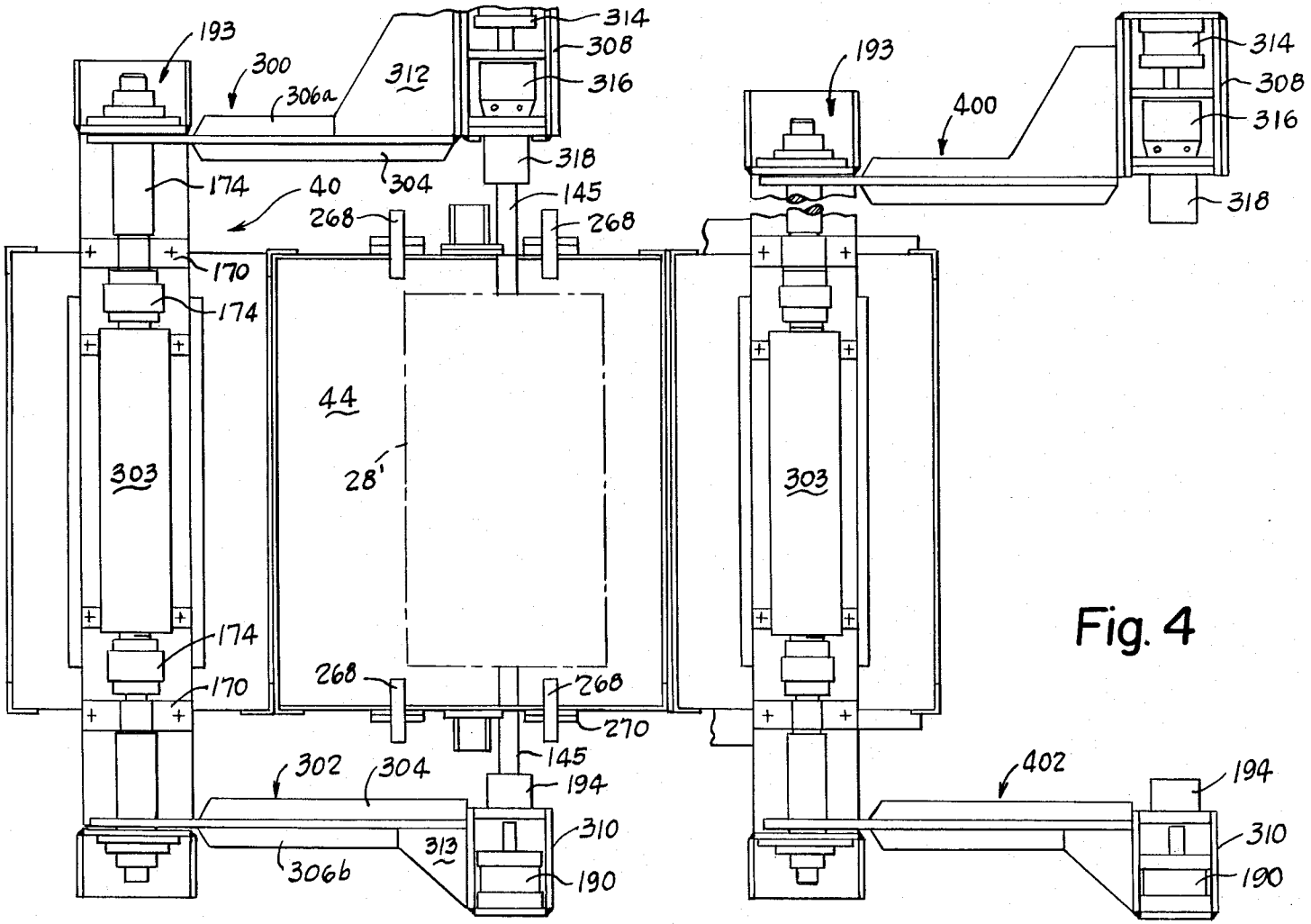
FIG. 4 is a fragmentary top plan view of the apparatus shown in FIGS. 2B–2C.

Referring to FIGS. 2A, 2B and 4, the slurry unit 34 includes a support stand 34*b* comprising vertical members 252 and cross members 254. The vertical members 252 sit atop and are fixed to the I-beam 158.

The slurry tank 34*a* includes a reservoir or sump 256 which contains a predetermined amount of a refractory slurry. In order to keep the materials in suspension, an agitator mechanism 258 is provided. The mechanism comprises a drive motor 260 connected to an agitator assembly 262 by a connecting rod 266.

The agitator assembly comprises a pair of vertical slide rods 268 slidably supported by slide blocks 270 that are fixed to the sides of the slurry tank 34*a*. The slide rods 268 are connected to an arcuate agitator 272 which as seen in the Figures has a shape that conforms closely to the shape of the reservoir 256. The agitator extends transversely across the sump 256 and is vertically reciprocated within the sump 256 by the motor 260. The agitator includes transverse members (not shown) which produce agitation in the slurry solution.

As seen in FIG. 2B, the lower portion of the drum 28' is submerged in the slurry solution when the drum is located on the drum rest 220*a*. The drum 28' is rotated in order to bring the entire drum assembly in contact with the slurry solution and coat all of the patterns carried by the drum.

In the preferred embodiment, rotation of the drum is imparted by the slurry transfer arm assembly 40. Referring also to FIG. 4, the slurry transfer arm assembly 40 is similar in construction to the pickup arm assembly 30. In particular, the transfer arm assembly 40 includes a pair of spaced, parallel arms 300, 302. Each arm is rotatably coupled to a rotary actuator 303 which may be identical to the actuator 168 used at the first transfer station 10. Similar or identical pillow blocks, drive shafts and couplings connect the arms 300, 302 with the actuator. The transfer arm assembly 40 is mounted atop the support stand 42 which as seen in FIG. 2B rests on interconnected I-beams 158, 305. The support stand 42 includes a main body 42*a* and a raised platform 42*b*.

In the illustrated embodiment, the arms 300, 302 are shorter than the pickup arms 162, 164. It should be noted however that the arms may be of similar length. Like the arms 162, 164, the arms 300, 302 include longitudinal rigidizing ribs 304, 306*a*, 306*b*. Sleeve members 308, 310 are mounted at the distal ends of the arms 300, 302. Gusset plates 312, 313 rigidize the mounting of the associated sleeves 308, 310.

Referring also to FIGS. 9–12, the arm 300 mounts an actuator 314 which may be the same or similar to the actuator 190 forming part of the arm 162. The sleeve 308 mounts a drive motor 316. The drive motor 316 is slidable mounted within the sleeve 308 and is driven towards and away from the end of the drum support shaft 145 by the actuator 314 via an actuation rod 314*a*. The movement of the drive motor towards and away from the shaft 145 effects the engagement and disengagement of the shaft 145 by the coupling member 318.

The coupling 318 is secured to the motor 316 by bolts 319. A motor shaft 316*a* is interconnected with a drive member 317 by a key 316*a*. The drive member 317 is supported by pair of spaced bearings 315. The outer end 317*a* of the drive member 317 is tapered. The tapered end 317*a* of the drive member is adapted to engage a slot (not shown) formed in the end of the drum supported shaft 145 whereby the motor shaft 316*a* is rotatably coupled to the drum shaft 145 such that rotation in the motor shaft produces attendant rotation in the drum support shaft 145.

The motor 316 is mounted for sliding movement within the sleeve member 308. A motor mounting plate 313 includes a slot 313*a* adapted to receive one or more fasteners each having a tapered head 311. The fastener 311 threadedly engages a sleeve plate 308*a* and keeps the motor 316 within the sleeve member 308 but allows sliding movement.

The arm 302, in the preferred embodiment, includes an actuator 190 and a coupling member 194 similar, if not identical in construction to the actuator and coupling member forming part of the arm 164. The coupling member 194 includes a collar-like element 320 which is connected to the actuator 190 by a connecting rod 190*a*. The element 320 is slidably carried within the sleeve member 310. The member 320 is mounted to a base plate 322 which includes a slot 322*a* similar to the slot 313*a* formed in the base plate 313 (see FIGS. 9 and 10). The slot 322*a* is adapted to receive tapered fasteners which are threadedly received by a sleeve plate 310*a* forming part of the sleeve member 310. The fasteners allow sliding movement in the plate 322 but keeps the coupling member 320 within the sleeve member 310.

As seen in FIG. 11, the coupling member 320 rotatably mounts an engagement member 324 which in the preferred embodiment includes a tapered end. The engagement member 324 is supported within the coupling member 320 by a ball bearing 325. As should be apparent, when a drum support shaft 145 is clamped between the coupling members 318 and 320, rotation of the motor drive shaft 316*a* rotates the drum shaft 145 and hence the drum 28. The coupling member 320 by the use of the rotatable engagement member 324 rotatably supports the opposite end of the shaft.

In order to engage a drum 28, the actuators 314, 190 are retracted to move the coupling members 194, 318 outwardly. The rotatory actuator 303 is then energized to rotate the arms 300, 302 counterclockwise until the coupling members are aligned with the drum support shaft 145 of the drum 28' located in the slurry tank 34*a*. After alignment has been achieved, the actuators 314, 190 are actuated to drive the coupling members 194, 318 inwardly to receive and engage the drum support shaft 145.

After engagement, the motor 316 is energized to produce rotation in the drum assembly 28' for a predetermined amount of time. The dwell time is selected to be of sufficient duration to cause all the patterns carried by the drum 28' to be coated with the slurry solution.

After the coating step is completed, the transfer arm assembly 40 is actuated to lift the drum assembly 28' from the slurry tank 34*a*. In the preferred method, the drum continues to rotate as it leaves the slurry sump or reservoir 256 to encourage excess slurry to drain from the patterns.

In accordance with this preferred method, the transfer arm assembly 40 eventually transfers the drum 28' to the slurry spin-off tank 44. The support shaft for the drum assembly is lowered onto a drum rest 350 which is similar if not identical to the drum rest 220*a* forming part of the slurry unit 34. After the drum is lowered onto the rest 350, the actuators 314, 194 are retracted so that the coupling members 194, 318 disengage the support shaft 145.

Referring to FIGS. 2B and 4, the slurry spin off tank 44 is similar in construction to the slurry tank 34*a*. To facilitate the explanation, like members are designated with the same reference characters. Like the slurry tank 34*a*, the spin-off tank includes a reservoir 256 and agitator assembly 262 reciprocally driven by a drive motor 260.

In the preferred embodiment, the spin-off tank 44 serves as a replenishment reservoir for the slurry tank 34*a*. With this arrangement, the slurry solution discharged by a drum 28' at the spin-off tank 44, is ultimately transferred back to the slurry unit 34. In a more preferred embodiment, as the slurry solution is depleted, the replenishment slurry is added to the slurry spin-off tank and then transferred to the slurry tank. As seen in FIG. 2B, a drain connection 362 and conduit 364 convey the slurry from the spin-off tank 44 to the slurry tank 34*a*.

In order to drive excess slurry from the drum assembly 28', the drum assembly is again rotated. In the preferred apparatus and method, the slurry tansfer arm assembly 40 disengages and moves away from the drum.

Referring also to FIG. 2C, a stucco transfer arm assembly 50 forming part of the third station 14 rotates to a position aligned with the drum 28' and engages the drum support shaft 145. The arm assembly is similar in construction to the arm assembly 40 and includes a similar pair of arms 400, 402, one of which mounts a coupling actuator 314, drive motor 316 and coupling member 318 for engaging and imparting rotation to the drum assembly. The other arms 402 mounts an actuator 190 and associated coupling member 194.

The stucco transfer arms engage the drum 28' at the slurry spin-off tank 44 and after engagement rotate the drum for a predetermined time in order to drive off excess slurry. After this operation is complete, the stucco transfer arm assembly 50 transfers the drum 28' to a stucco tank 56. As is conventional, the stucco tank includes a fluidized bed of refractory material. The drum 28' is discharged onto a drum rest 380 similar in construction to the drum rest 220*a* and then is disengaged by the stucco transfer arm assembly 50.

A fourth transfer arm assembly 60 which is virtually identical in construction to the transfer arm assembly 50 engages the drum 28 and rotates it so that the patterns, still covered with wet slurry are then uniformly coated with the stucco material which usually comprises a powdered refractory material having a particle size that is larger than the particle size of the material making up the refractory slurry. After a predetermined coating time, the arm assembly 60 is actuated and transfers the drum 28' to a scraping unit 66. As explained earlier, the drum assembly contains one or more "splitters" which enable the drum and hence the finished casting molds to be disassembled and removed from the drum assembly. To facilitate the separation of the splitters, the refractory coating is scraped off.

To achieve this function, the scraping station includes one or more scraping members 400 (the number of members 400 correspond to the number of splitters on the drum) which are moved into scraping contact with the splitters.

As seen in FIG. 2C, the drum 28' is discharged onto a drum rest 410 by the arm assembly 60. A final transfer arm assembly 70 then engages the opposite ends of the support shaft to impart rotation to the drum 28' while at the scraping unit 66.

The final transfer arm assembly 70 includes a pair of arms similar to the arms 162, 164 and arms 300, 302. Like the arms 300, 302 one arm includes an actuator 314 and reciprocally mounted on drive motor 316 that carries a coupling member 318 on its output shaft whereas the other arm includes an actuator 190 and coupling member 194.

In the preferred apparatus and method, the arm assembly 70 engages the drum support shaft 145 and produces rotation in the drum via the drive motor 316 mounted at the end of one of the arms. The scraper members 400 are pivotly mounted on the right side of the tank (as viewed in FIG. 2C) and are moved towards and away from an associated splitter by an actuator 430. In the preferred embodiment, each scraper member 400 includes an associated actuator 430. All of the scraper members 400 may have a common pivot axis indicated by the reference character 432. After a predetermined scraping time, the transfer arm assembly 70 is actuated to transport the coated drum assembly 28' to one of four positions on a transfer cart 436 located at a discharge station 22.

In the preferred apparatus, the transfer cart 436 is identical in construction to the transfer cart 26 located at the beginning of the process line and mounts a plurality of drum assemblies in spaced vertical alignment at opposite ends of support members.

Referring to FIG. 2D, since the radial distance between the transfer arm pivot axis 70*a* and support members 146 varies, the arm assembly 70 is mounted on a transversely movable slide assembly 438. In the preferred apparatus, the construction of the slide assembly 438 and associated support stand is substantially identical to the construction of the slide assembly 166 and the support stand 32 forming part of the first station 10. As a result, a detailed description of the support stand 72 and slide assembly 438 is unnecessary.

As indicated previously, the discharge station 22 includes a turntable assembly 90 like the turntable assembly 24 located at the load station 20. In the preferred operation, after one side of the transfer cart 436 is loaded, the turntable 90 is energized to rotate the transfer cart 180° to present the opposite sides of the support members 146 to the final transfer arm assembly 70 so the support members can be sequentially loaded with coated drum assemblies.

It should be apparent that the present apparatus provides a fully automatic method and apparatus for making investment castings. The drum assemblies to be coated are loaded onto the transfer cart 26 and rolled onto the turntable assembly 24. The pickup arm assembly 30 sequentially transfers the drums 28 from the cart 26 to the slurry unit 34. The other arm assemblies 40, 50, 60, 70 then transfer the drum 28' to successive stations until it reaches the discharge transfer cart 436. From there the coated drums 28' are dried or cured and if desired can then be brought back to the initial turntable assembly 24 to receive another coating of ceramic material. This cycle is repeated until a desired coating thickness is formed on the patterns.

Although this invention has been described with a certain degree of particularity, it is to be understood that those skilled in the art can make various changes to it without departing from the spirit or scope of the invention as herein after claimed.

I claim:

1. An apparatus for automatically forming ceramic shell molds comprising:

(a) a first support structure for supporting a plurality of set ups;

(b) a pickup arm assembly movable about a substantially transverse axis between a set up receiving position and a set up discharging position, said discharging position located at a slurry unit;

(c) means for imparting rotation to said set up while at the slurry unit;

(d) a first transfer arm assembly operative to engage said set up and transfer said set up to a slurry spin-off tank;

(e) means for rotating said set up at said spin-off tank to drive off excess slurry from said set up;

(f) a second transfer arm assembly for transferring said set up from said spin-off tank to a stucco tank;

(g) means for rotating said set up at said stucco tank;

(h) a third transfer arm assembly for transferring said set up from said stucco tank to a scraper unit for scraping stucco material from predetermined regions on said set up;

(i) a discharge arm assembly for engaging said set up at said scraper unit and transferring it to a second support structure;

(j) all of said transfer arm assemblies arranged in juxtaposed positions such that a substantially rectilinear processing line for said setups is provided.

2. The apparatus of claim 1 wherein said first and second support structures each include a transfer cart and a turntable supporting said transfer cart for rotation about a substantially vertical axis.

3. The apparatus of claim 1 wherein said first support structure comprises a movable transfer cart.

4. The apparatus of claim 3 further comprising a turntable for supporting said transfer cart for rotation about a substantially vertical axis.

5. The apparatus of claim 1 wherein said means for imparting rotation to said set-up assembly forms part of said first transfer arm assembly.

6. Apparatus for automatically forming ceramic shell molds, comprising:

(a) a first station inluding a first set up support for carrying a plurality of set up assemblies and a pickup arm assembly rotatable about a substantially transverse axis and operative to sequentially transfer each of said set up assemblies to a slurry tank forming part of a second station located laterally adjacent said first station;

(b) said second station further including a transfer arm assembly for transferring a set up assembly for said slurry tank to a slurry spin-off tank forming part of said second station;

(c) a third station including another transfer arm assembly for engaging said set up assembly at said spin-off tank and transferring said assembly to a stucco tank forming part of said third station;

(d) a fourth station located laterally adjacent said third station and including a scraper unit for scraping slurry and stucco material from predetermined portions of said set up assembly and another transfer arm assembly for engaging said set up assembly at said stucco tank and transferring it to said scraper unit; and, (e) a fifth station including a discharge arm assembly operative to engage the set up assembly at said scraper unit and transfer it to a second set up support;

(f) said second, third and fourth stations being arranged in a juxtaposed relationship such that a substantially rectilinear processing line is provided for said set up assemblies.

7. The apparatus of claim 6 wherein said first and fifth stations each include a transversely slidable means for supporting said pickup arm assembly and discharge arm assembly, respectively, said slidable means enabling said arm assemblies to move laterally towards and away from respective set up supports.

8. The apparatus of claim 6 wherein said spin-off tank serves as a replenishment reservoir for said slurry tank.

9. The apparatus of claim 6 wherein said transfer arm assemblies each comprise a pair of parallel, radial extending arms, each of said arms including a drum engagement means located near a distal end of each arm.

10. The apparatus of claim 8 wherein one of said arms of a pair carries a driving means for imparting rotation to a set up engaged by said pair of arms.

11. Apparatus for automatically forming ceramic shell molds, comrising:

(a) a plurality of processing stations arranged in juxtaposed position to define a substantially rectilinear process line for coating set up assemblies, said processing line extending from a first set up support rack located at one end of said processing line and a second, substantially similar support rack located at the end of said processing line;

(b) a first of said processing stations comprising a pickup arm assembly operable to engage a set up assembly on said first support rack and transfer it along a substantially vertical, arcuate path from said first support rack to a slurry tank;

(c) a second of said processing stations located adjacent said first station and including a transfer arm assembly operative to engage and impart rotation to a set up assembly at said slurry tank for a predetermined amount of time and being further operative after said predetermined amount of time, to transfer said set up assembly along a substantially vertical arcuate path to a slurry spin-off tank;

(d) a third of said processing stations comprising another transfer arm assembly operative to engage and impart rotation to a set up assembly at said slurry spin-off tank for a predetermined amount of time, and being further operative to transfer said set up assembly from said spin-off tank to a stucco tank along a substantially vertical, arcuate path;

(e) a fourth of said processing stations located laterally adjacent said third station and including a transfer arm assembly operative to engage and impart rotation to a set up assembly at said stucco tank for a predetermined amount of time and being further operative after said predetermined time, to transfer said set up assembly along a predetermined path from said stucco tank to a scraper unit;

(f) a fifth of said processing stations including a transfer arm assembly for engaging and imparting rotation to a set up assembly at said scraper unit to scrape slurry and stucco material from predetermined portions of said set up assembly and being further operative to transfer said set up assembly along a predetermined path from said scraper unit to said second set up support rack.

12. The apparatus of claim 10 wherein said first and second support racks each comprise a movable transfer cart.

13. The apparatus of claim 12 wherein said first support rack further includes a turntable assembly operative to rotate said transfer cart about a substantially vertical axis to present predetermined regions on said cart to said pickup arm assembly.

14. A method for coating a set up in an investment casting process, comprising the steps of:

(a) positioning a plurality of set ups in spaced vertical relationship;

(b) positioning a slurry tank, a slurry spin-off tank, a stucco tank and a scraper unit in a juxtaposed relationship whereby a substantially rectilinear processing line for processing said set ups is provided;

(c) transferring one of said set ups from said vertical spaced position to said slurry tank by moving said set up assembly through a substantially vertical arc;

(d) rotating said set up for a predetermined time at said slurry tank;

(e) transferring said set up from said slurry tank to said slurry spin-off tank by moving it along a substantially vertical ar;

(f) rotating said set up for a predetermined time at said spin-off tank to drive off excess slurry;

(g) transferring said set up from said spin-off tank to said slurry tank;

(h) rotating said set up for a predetermined time at said stucco tank;

(i) transferring said set up from said stucco tank to said scraper unit and scraping slurry and stucco material from portions of said set up; and, (j) transferring said set up from said scraper unit to a set up support structure.

* * * * *